US009168533B2

(12) United States Patent
Chiou et al.

(10) Patent No.: US 9,168,533 B2
(45) Date of Patent: Oct. 27, 2015

(54) THERMAL CYCLER DEVICE

(71) Applicant: CrackerBio, Inc., Hsinchu County (TW)

(72) Inventors: Chung-Fan Chiou, Hsinchu County (TW); Yung-Chin Lee, Miaoli County (TW)

(73) Assignee: CrackerBio, Inc., Hsinchu County (TW)

( * ) Notice: Subject to any disclaimer, the term of this patent is extended or adjusted under 35 U.S.C. 154(b) by 131 days.

(21) Appl. No.: 13/943,808

(22) Filed: Jul. 17, 2013

(65) Prior Publication Data

US 2015/0024474 A1 Jan. 22, 2015

(51) Int. Cl.
*B01L 7/00* (2006.01)

(52) U.S. Cl.
CPC ..... *B01L 7/5255* (2013.01); *B01L 2300/0803* (2013.01); *B01L 2300/0822* (2013.01); *B01L 2300/185* (2013.01); *B01L 2300/1838* (2013.01)

(58) Field of Classification Search
CPC ..... C12M 23/48; C12M 41/14; C12M 27/10; C12M 27/12; B01L 7/00
USPC ..... 435/283.1–309.4
See application file for complete search history.

(56) References Cited

U.S. PATENT DOCUMENTS

| | | | | |
|---|---|---|---|---|
| 5,176,203 | A * | 1/1993 | Larzul | 165/61 |
| 5,187,084 | A | 2/1993 | Hallsby | |
| 5,333,675 | A | 8/1994 | Mullis et al. | |
| 5,525,300 | A | 6/1996 | Danssaert et al. | |
| 5,736,106 | A * | 4/1998 | Ishiguro et al. | 422/131 |
| 2008/0182301 | A1 * | 7/2008 | Handique et al. | 435/91.2 |

FOREIGN PATENT DOCUMENTS

WO 2012161566 11/2012

OTHER PUBLICATIONS

Zhang et al., "Survey and Summary Miniaturized PCR chips for nucleic acid amplification and analysis: latest advances and future trends", Nucleic Acids Research, Jun. 2007, vol. 35, No. 13, p. 4223-p. 4237.

"Office Action of Taiwan Counterpart Application", issued on Dec. 17, 2014, p1-p5.

* cited by examiner

*Primary Examiner* — Nathan Bowers
*Assistant Examiner* — Lydia Edwards
(74) *Attorney, Agent, or Firm* — Jianq Chyun IP Office

(57) ABSTRACT

The present invention relates to a thermal cycler device for carrying reaction slides for assays with thermal cycling reactions. The thermal cycler device includes a conveyer with a plurality of slide holders for conveying slide plates through more than one temperature zones for thermal cycling reactions.

15 Claims, 6 Drawing Sheets

THERMAL CYCLER DEVICE

BACKGROUND

1. Technical Field

The present invention relates to a bio-reaction device. Particularly, the present invention relates to a thermal cycler device.

2. Related Art

For molecular bio-technology related to the polymerase chain reaction (PCR), it is important that the thermal cycling device is able to provide a programmed temperature profile for the amplification reaction of the sample(s). Traditional thermal cycling devices, also called thermal cycler devices, are mostly designed for test tubes, sample vials or multi-well plates with larger volume. As the volume size of the vial or reaction well keeps decreasing, the tolerance in the variation of the temperature profile within each reaction well becomes smaller.

For the traditional thermal cycler, the sample vials or plates are placed on the heat block of the thermal cycler and the temperature within the reaction well is controlled by the heat block to fulfil the thermal cycling. For the reaction wells of small sizes undergoing the biochemical reaction, it is difficult to avoid the inconsistent temperature profiles between the sample plates or between the reaction wells of the sample plate due the positional differences on the heat block.

It is desirable to provide a thermal cycler device capable of providing the uniform temperature profile for the vials or reaction wells of the plates to accomplish the goal of thermal cycling.

SUMMARY

The present invention provides a thermal cycler device, suitable for handling one batch of large numbers of samples. In addition, such thermal cycler device can provide reliable and uniform temperature profiles for the small-sized reaction vessels of biochemical reactions, such as nano-well slide plates, with high repeatability.

The present invention provides a thermal cycler device, including at least a closed loop conveyer and a fixed conveying path, the conveyer has a plurality of holders distributed in equal distance along the conveying path. The present invention also includes a plurality of temperature zones and their respective temperature controllers along the conveying path. The holders are used for carrying and conveying slide plates along the conveying path. The slide plate having a plurality of reaction vessels. The plurality of slide plates carried by the holder passes through the temperature zones along the conveying path sequentially, and thereby exchanges heat with surrounding medium within the temperature zones. As a result, a desired temperature profile of the reaction solution is obtained via the slides carried around the looped conveying path repeatedly and through different temperature elevations during conveying.

According to embodiments of the present invention, the temperature of each temperature zone is set to a fixed temperature.

According to embodiments of the present invention, the temperature of the each temperature zone is set to a fixed temperature gradient.

According to embodiments of the present invention, the heat exchange between temperature zones and slide plates is through convection via flowing heat medium or through conduction via direct contacting with the heat block.

According to embodiments of present invention, the holder and conveyer may be moving at a constant speed or moving to the next position in a high speed and pause for a pre-determined period before making next move.

According to embodiments of present invention, the thermal cycler device further includes one or more of the group of an optical detection device, a fluorescent camera and a bar code reader.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

The invention relates to a thermal cycler device for biochemical reactions. This thermal cycler device is capable of providing precisely controlled temperature profile for the sample undergoing biochemical reactions in the reaction vessel(s). This thermal cycler device is able to handle numerous samples carried by up to ten thousands nano-wells, in one batch for thermal cycling or other biochemical reactions.

A sample may include one or more nucleic acid fragments (DNAs or RNAs) and several ingredients used for a particular biochemical reaction or a biochemical test. For example, in the test using polymerase amplification reaction, the sample may include one or more nucleic acid fragments, a pair of primers, enzymes, dNTP, fluorescent reporters, salts and etc. During application, the different primer pairs and fluorescent reporters may be added to the reaction vessel firstly, and then followed by mixing the enzymes, dNTP, and other additives with the sample to the reaction vessel.

Figure 1:
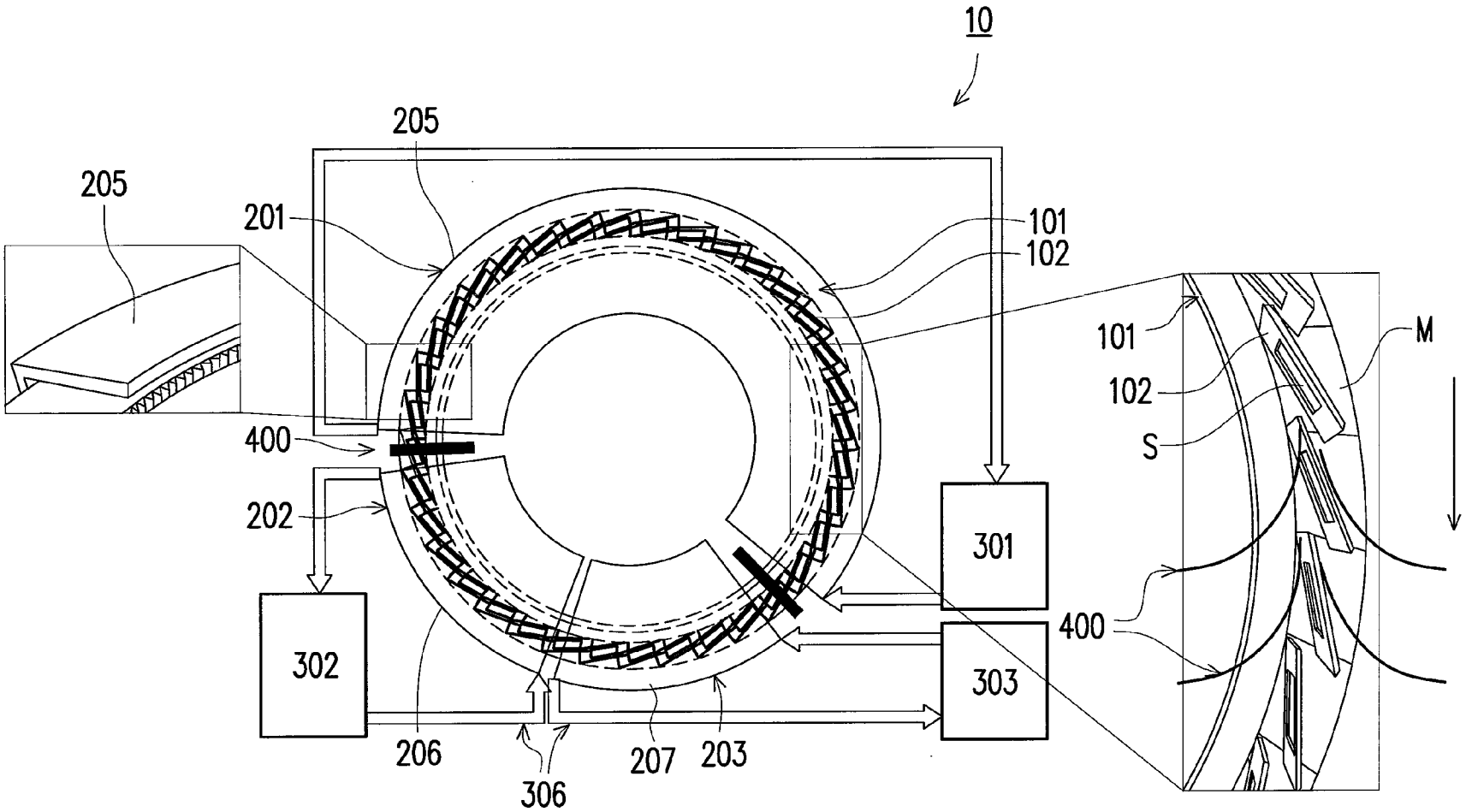
FIG. 1 schematically shows a thermal cycler device according to one embodiment of the present invention.

FIG. 1 schematically shows a thermal cycler device according to one embodiment of the present invention. The thermal cycler 10 includes a slide plate conveyer 101 for carrying and conveying the slide plate holder 102 and one or more different temperature zones. The slide plate conveyer 101 may be in a form of a track-type or chain-type conveyer belt or a conveyer wheel, for example. In FIG. 1, the slide plate conveyer 101 may be a cyclic conveyer belt revolving clockwise (the moving direction shown as the arrow), carrying the slide via the slide plate holders 102 through the different temperature zones. When the cyclic conveyer belt rotates, the slide plates S thereon are carried through the different temperature zones and heated or cooled by exchange heat within the different temperature zones. The slide plate holders 102 are distributed equally along the conveying path (i.e. separated with an equal distance). For example, in a belt or wheel type conveyer of length L with M slide holders, the distance between neighbouring slides is L/M and the angle between slides is 360°/M. That is, with 36 slide holders, the slide holders are separated by at an angle of 360/36=10 degrees along the cyclic conveyer in this particular embodiment. The shape(s), size(s) and position(s) of the different temperature zones may be modified according to the type or shape of the slide plate conveyer 101.

A slide plate holder 102 may hold slide plates S. The slide plate S may be a titer plate or micro-plate having a plurality of nano-wells (or micro-wells) or a slide plate or an assay array plate having one or more reaction vessels, a tube plate or a vial plate carrying a plurality of micro-vials, for example. Reaction vessel may represent the hole(s) or well(s) in the microtiter plate, the individual reaction well(s) or pit(s) in the test slide plate or the array plate. As described herein, the "slide plate", "slide", "plate" or "assay plate" may refer to the same substrate plate accommodating the reaction vessels. Preferably, the reaction vessel may be individual reaction well(s) or pit(s) in the test slide or the assay array plate. The slide plate may include its package cover. The slide plat may include an oil bath dish. Therefore, when saying direct in contact with slide plate may refer to contacting any part of the slide plate or its package cover or oil bath dish or other type of package.

As shown in the enlarged 3D view of a portion of the thermal cycler 10 in FIG. 1, the slide plates S carried by the slide holder 102 that sits on the conveyer 101 are arranged slanting ways (i.e. having a specific tilt angle) to the moving direction (shown as the arrow) of the conveyer 101 and there are gaps between any two adjacent slide plate holders 102. The gaps make sure that the slide can be surrounded by the heat medium in order to ensure that the temperature of each region in the slide is uniform.

The thermal cycler of this invention may include one or more different temperature zones. Each of the temperature zones may be set to remain a constant temperature when undergoing the thermal cycle. Alternatively, each of the temperature zones may be set to have a temperature gradient. For example, a particular temperature zone may be set at 105° C. at the entrance, and then descended to 95° C. at the middle and remaining at 95° C. to the exit; thereby, when a slide plate of 60° C. enters into such temperature zone will be heated from 60° C. to 95° C. as being conveyed through the temperature zone. That is, the sample carried by the slide plate will undergo the temperature gradient when moving in the temperature zone.

In this embodiment, the thermal cycler 10 includes a first temperature zone 201, a second temperature zone 202 and a third temperature zone 203. The first, second and third temperature zones 201, 202, 203 are adjacent to but are separated from one another. Alternatively, the different temperature zones may be connected to one another, but with isolation components there-between. Each of the first, second and third temperature zones 201, 202, 203 may include a casing, a semi-opened or closed ring structure, covering portions of the slide plate conveyer 101. The casing is shaped like a corridor for accommodating the slide plate conveyer 101 passing through. In this embodiment, each of the first, second and third temperature zones 201, 202, 203 includes a pair of first heat blocks 205, a pair of second heat blocks 206 and a pair of third heat blocks 207 respectively. Each pair of the first, second and third heat blocks 205, 206, 207 is arranged at the two opposite sides of the slide plate conveyer 101. For example, the two first heat blocks 205 may consist of a semi-opened ring structure, and the two first heat blocks 205 are respectively arranged at the upper side and the lower side of the slide plate conveyer 101, so as to cover a portion of the slide plate conveyer 101 within the first temperature zone 201. The first temperature zone 201 includes the two first heat blocks 205 and a heat medium M circulating and flowing within the first temperature zone 201 so as to provide a first temperature for the slide plates passing through the first temperature zone 201. Similarly, along with the heat medium M, the two pairs the second and third heat blocks 206, 207 are arranged at the upper side and the lower side of the slide plate conveyer 101 within the second temperature zone 202 and the third temperature zone 203 so as to provide a second temperature and a third temperature for the slide plates passing through the temperature zones 202, 203. The three pairs of the first, second and third heat blocks 205, 206, 207 are arranged side by side along the circling path of the slide plate conveyer 101.

The temperatures of the heat medium M in the first, second and third temperature zones 201, 202, 203 are respectively controlled by temperature controllers 301, 302, 303. For each temperature zone, the heat medium M is circulating within the circulating pipes 306 connected between the corresponding temperature zone and the corresponding temperature controller. The heat medium M may be water, air, inert gas, mineral oil or inactive fluids, for example. The heat medium used in the first, second and third temperature zones 201, 202, 203 may be the same or different.

The temperatures of the first, second and third heat blocks 205, 206, 207 in the first, second and third temperature zones 201, 202, 203 may be respectively controlled by temperature controllers 301, 302, 303. Alternatively, the temperatures of the first, second and third heat blocks 205, 206, 207 in the first, second and third temperature zones 201, 202, 203 may be respectively controlled by additional controllers.

Additionally, the thermal cycler 10 includes one or more isolation components 400 disposed between different temperature zones 201, 202, 203. The isolation component 400 disposed between two adjacent temperature zones can reduce or avoid mutual interference from the different temperature zones. The isolation component 400 will not hinder the movement of the slide plates 102 and the slide plate conveyer 101, but it can stop the heat exchange between different temperature zones. The isolation component 400 may be an elastic partition composed of flexible bristles or a single or multiple-layered flexible shutter, for effectively preventing the interflow of the heat medium (such as hot air or hot water) between two temperature zones.

As shown in the enlarged 3D view of a portion of the thermal cycler 10 in FIG. 1, the isolation component 400 may be flexible bristles oblique to the moving direction (shown as arrows) of the slide plates for better isolation effects.

Figure 2:
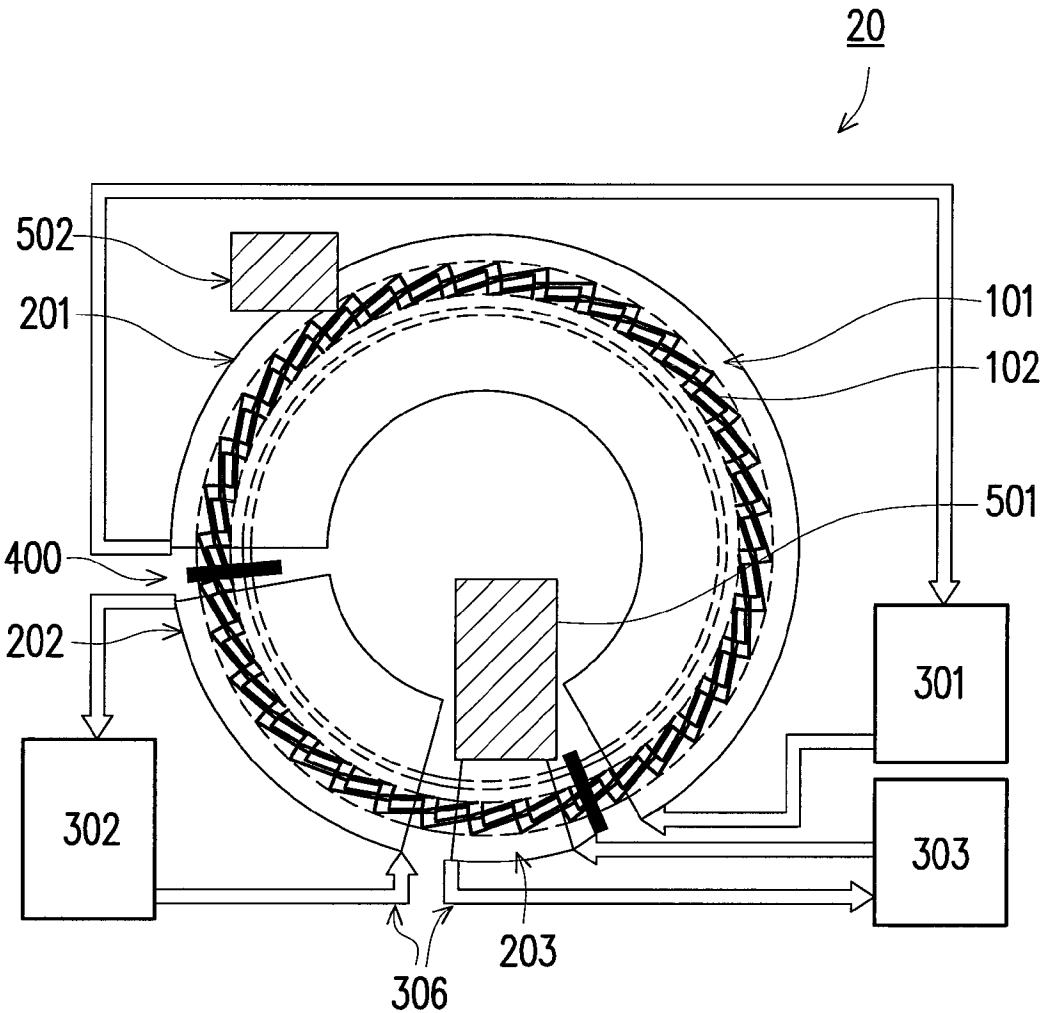
FIG. 2 schematically shows a thermal cycler device according to another embodiment of the present invention.

FIG. 2 schematically shows a thermal cycler device according to another embodiment of the present invention. The thermal cycler 20 includes a slide plate conveyer 101 for carrying the slide plate holder 102. The thermal cycler device 20 also includes a first temperature zone 201, a second temperature zone 202 and a third temperature zone 203. Different to the device 10 of FIG. 1, the temperatures of the first, second and third temperature zones 201, 202, 203 are respectively controlled by the first, second and third temperature controllers 301, 302, 303 through the heat medium M. That is, the temperatures of the first, second and third temperature zones 201, 202, 203 are set by the heat medium M filled therein, and the heat medium M of the preset temperature(s) will be perfused into the corresponding temperature zone(s). Hence, the heat block(s) may be located within the temperature controllers 301, 302, 303 or other locations, rather than located within the temperature zones 201, 202, 203. The heat mechanism of the heat block or temperature controllers may be, but not limited to, resistive heating, microwave heating, radiant heating, or infrared radiation heating. Additionally, the temperature controllers 301, 302, 303 may also include cooling means or cooling device. The cooling mechanism may be, but not limited to, air cooling, liquid cooling, or cooling chips, for example.

As shown in FIG. 2, the thermal cycler 20 includes at least one optical detection device 501 and a label reading device 502. The optical detection device 501 can detect optical signals from the dye or fluorescent signals from the fluorescent reporters of the sample. The location of the optical detection device 501 may be set at a location between the temperature zones or at one of the temperature zones, depending on the ongoing biochemical reactions. The optical detection device 501 may be an image sensor, including a CCD image sensor, a CMOS sensor, a photomultiplier tube (PMT) detector or a fluorescence camera, for example. The optical detection device may use a laser, a LED light source or a mercury lamp as the excitation source. In principle, the slide plate holders 102 (as well as the slide and the samples hold in the reaction vessels of the slides) moves through the optical detection device 501 sequentially. The label reading device 502 can read handwriting marks, barcodes or other marks labelled on the slide plates 102.

Figure 3:
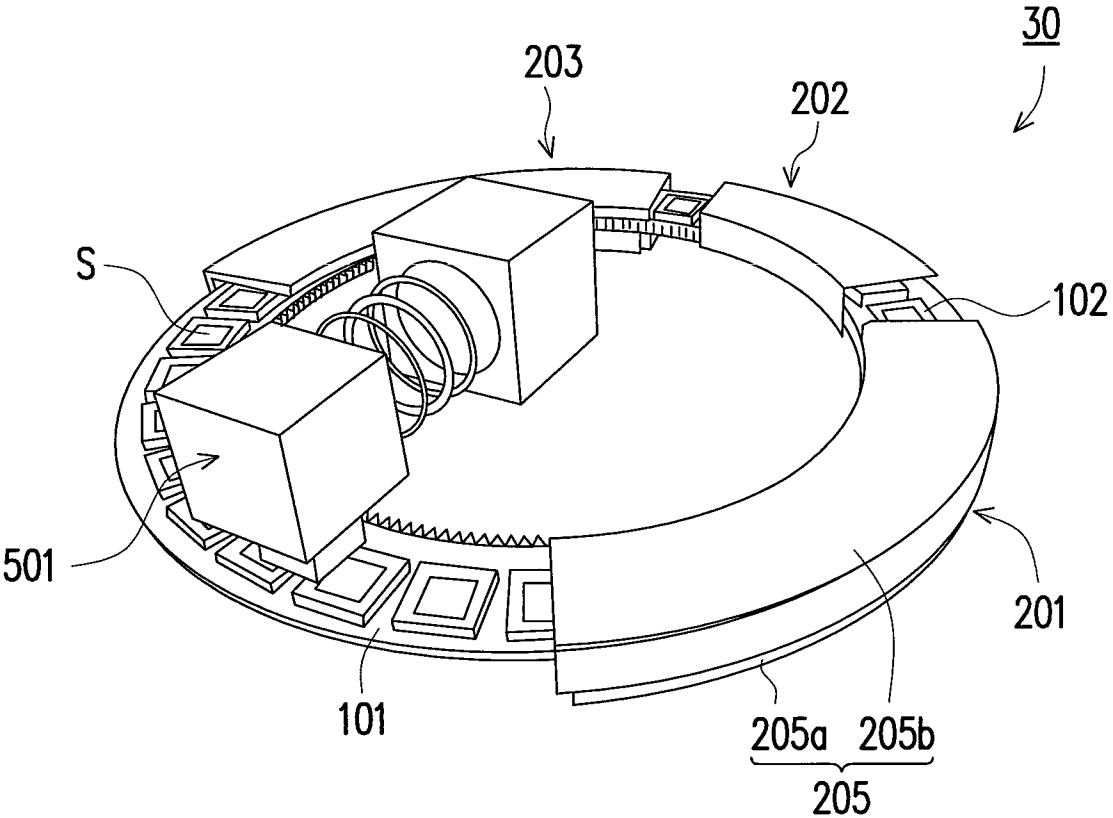
FIG. 3 schematically shows a thermal cycler device according to another embodiment of the present invention.

FIG. 3 schematically shows a thermal cycler device according to another embodiment of the present invention. As shown in FIG. 3, the slides S carried by the slide plate holders 102 are laid flatly on the slide plate conveyer 101 and pass through the temperature zones 201, 202, 203. The heat block may transfer heat to or receive heat from the sample through conduction (i.e. for the slides in direct contact with the heat block surface) or through convection (i.e. for the slides not in direct contact with the heat block surface). In this embodiment of the present invention, the pair of heat blocks 205 of the temperature zone 201 may shape like a tunnel having a floor heat block 205*a* and a ceiling heat block 205*b*. The slide(s) carried by the holder 102 is in direct contacted with the floor heat block 205*a* and heat is being transferred from the floor heat block 205*a* via conduction. The slide(s) is not in contact with the ceiling heat block 205*b* and heat is being transferred from the ceiling heat block 205*b* to the slide via thermal convection.

In the present invention, the heat block is being heated or cooled by a heat source or heat sink. The heat source or heat sink may be designed to be located within the temperature zone(s) or located outside the temperature zone(s). The heat source and heat sink may be a Peltier effect heat pump, a resistance wire heating device, or an infrared radiator heating device. The heat block may directly exchange heat with the slide plates or exchange heat through heat medium circulation. The heat medium may be water, air or oil.

Figure 4:
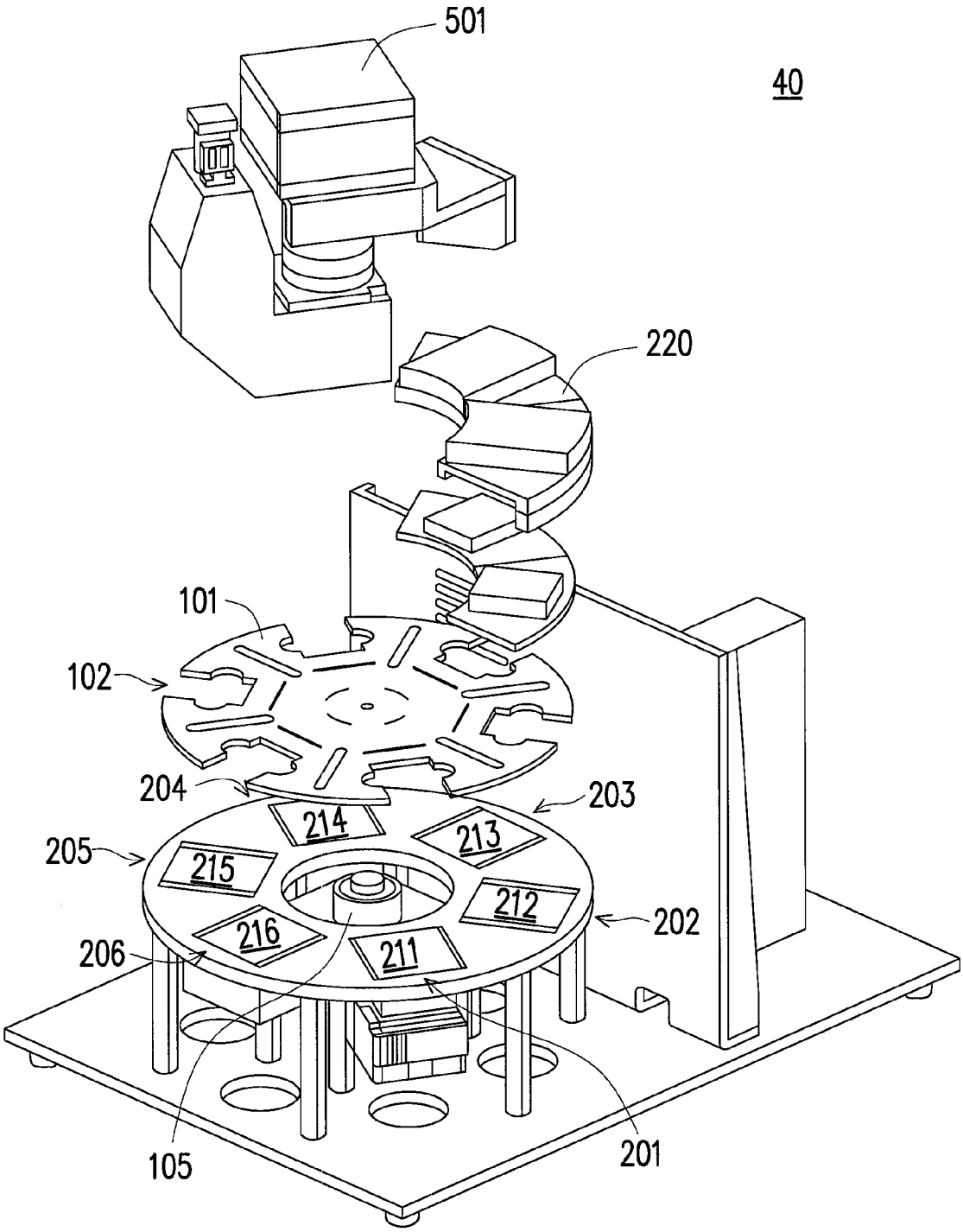
FIG. 4 schematically shows a thermal cycler device according to another embodiment of the present invention with 6 holders and 6 temperature zones.

FIG. 4 schematically shows a thermal cycler device according to another embodiment of the present invention. As shown in FIG. 4, the cyclic conveyer 101 has 6 slide plate holders 102, each holder is arranged side by side in an angle of 60 degree along the circular conveying path. An example of setting temperature zone to provide a target temperature profile is described as following. The targeting PCR temperature profile is more than 1 second at 95° C. for denature and more than 5 seconds at 60° C. for annealing. Each of the 6 temperature zones 201-206 includes a corresponding floor heat block 211~216. A tunnel-shaped ceiling heat block 220 is installed above two of the temperature zones 202, 203. The floor heat blocks 211~216 in the temperature zones 201-206 are set to, from zone 201 to zone 206: 60° C., 105° C. (floor)/95° C. (ceiling), 95° C. (floor)/95° C. (ceiling), 50° C., 60° C., 60° C., for example. To accelerate temperature changes in the slide plate, one of the heat block is set to 105° C., 10 degrees higher than the targeting temperature of 95° C., to increase the driving force of heat exchange; vice versa, one of the heat block is set to be 50° C. 10 degrees lower than targeting temperature of reaction vessels inside the slide plate of 60° C., to shorten the time required for cooling down the slide temperature from 95° C. to 60° C. For example, the temperature zone 202 and zone 203 may be combined to form a temperature zone with a temperature gradient from 105° C. to 95° C. Also, the temperature zones 5 and 6 may be combined to become a temperature zone setting with a constant temperature at 60° C.

As shown in FIG. 4, a conveyer driving motor 105 is installed at the center of the disk-like conveyer 101. The cycling conveyer 101 is moving stepwise by fast advancing 60 degrees and staying 15 seconds; thereby, completed one cycle by 90 seconds. A two-stage polymerase chain reaction, 95° C./60° C., can be done by every circulation.

As shown in FIG. 4, an optical component 501, such as a camera and associated light source and filter set, is installed above the temperature zone 1. The camera takes fluorescent image(s) of each slide at each cycle. The camera may also serve as a label reader. Alternatively, another label reader may be installed.

Figure 5:
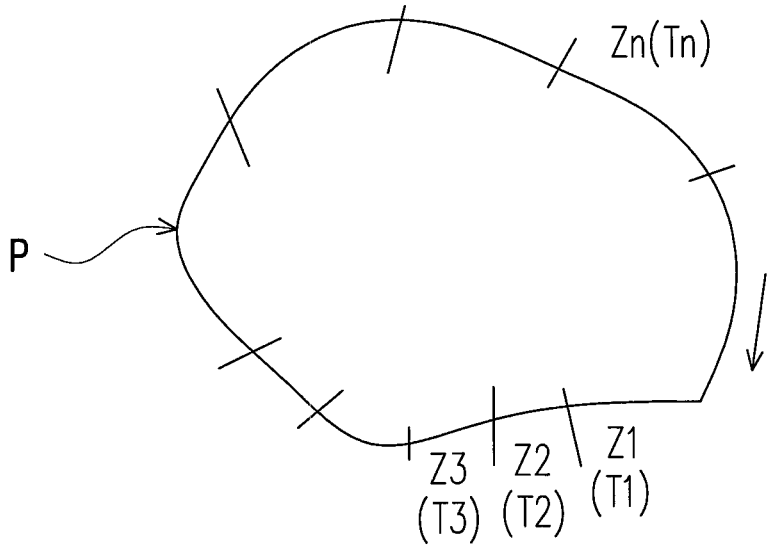
FIG. 5 shows the exemplary circling path of the thermal cycler device according to one embodiment of the present invention.

FIG. 5 shows the exemplary circling path of the thermal cycler device according to one embodiment of the present invention. As mentioned above, like the Ferris wheel bringing passengers following a fixed conveying path with different elevation along the path, the conveyer of the thermal cycler device may be a belt conveyer, a disc conveyer or a wheel conveyer, and the conveyer is designed to move along a circling path P (the clockwise revolving direction is shown as an arrow). The circling path P is a closed loop path. The plural temperature zones Z1, Z2, Z3 . . . Zn are arranged along the circling path P and the plate holder will carry slide plates moving through the temperature zones Z1~Zn along the circling path P. The slide plates and the test samples carried on the slide plates pass through the temperature zones Z1~Zn along the circling path P one by one, and the slide plates and the test samples are individually being heated up or cooled down to the temperatures T1~Tn of the temperature zones Z1~Zn along the path P, thus accomplishing the thermal cycle of the PCR or biochemical reaction(s). Following the mechanism of the thermal cycler device of this disclosure, no temperature zones or no heat blocks are idling or inoperative during the thermal cycles of PCR.

In this disclosure, it is understood that the temperature profile or temperature gradient of the temperature zones, the size or length of the temperature zones, or the arrangement of the temperature zones along the path may be modified or adjusted according to the temperature profile requirements of the biochemical reaction and/or the thermal conduction rate between the temperature zone(s), heat medium and the test sample(s).

For example, the sample(s) contained in the reaction vessels or nanowells of the slide plate(s), vials or microtiter plates may be nucleic acid fragments together with the PCR reaction mixtures, and the sample carried by the plate holder moves through different temperate zones and undergoes programmed temperature cycles for the amplification reaction or other biochemical reactions.

Figure 6:
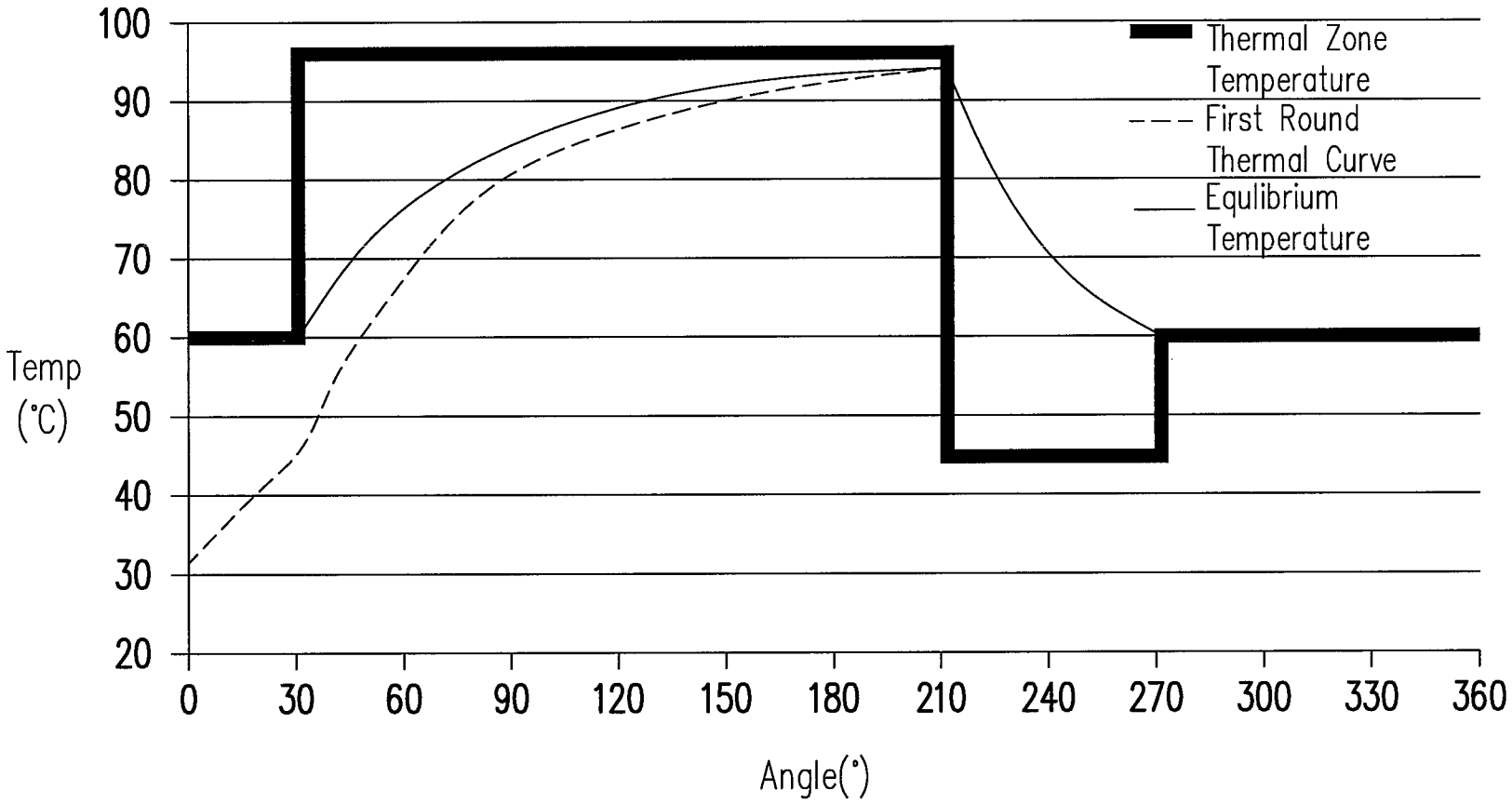
FIG. 6 shows the temperature simulation result of the thermal cycler device according to one embodiment of the present invention.

FIG. 6 shows the temperature simulation result of the thermal cycler device according to one embodiment of the present invention. The X-axis refers to the position (marked as the circumferential angle) of the slide plate, while the Y-axis is the temperature (in Celsius degrees). The bold line shows the temperature of the heat block(s) from the starting point and the set temperatures in the temperature zones (the positions expressed as the circumferential angles). The dotted line represents the temperature curve of the slide plate in the first round, while the solid line represents the temperature curve of the slide plate in subsequent round(s). Taking each cycle of the thermal cycles being 90 seconds as an example, the time for the plate holder passing one round of the circling path (one lap time) must also be 90 seconds. The size(s) or length of the temperature zone(s) is calculated based on the time required for the sample to reach the set temperature. For example, the temperature of the sample changing from 60° C. to 95° C. takes 60 seconds when heated by the heat block of 95° C., and the temperature of the sample cooling from 95° C. to 60° C. takes 30 seconds. In this case, according to the time required for heating or cooling, two thirds of the length of the conveying path is set to be at the temperature of 95° C. (the temperature zone set at 95° C.), one third of the length of the conveying path is set to be at the temperature of 60° C. (the temperature zone set at 60° C.). The optical detection device may be arranged in the conveying path in the temperature zone set at 60° C. For the plate holder using a round conveying wheel and the conveying path (circling path) being a circular path with the circumferential angle of 360 degrees, the temperature zone set at 95° C. is located at the circumferential angle of 240 degrees and the temperature zone set at 60° C. is located at the circumferential angle of 120 degrees.

As mentioned above, the temperature of the temperature zone(s) may be set at a fixed temperature, a stepwise discontinuous temperature gradient or a continuous temperature gradient. During the thermal cycles of PCR, the temperature of the temperature zone(s) remain at the set fixed temperature or remain at the set temperature gradient.

The thermal cycler device of the present invention can simultaneously carry slide plates with numerous reaction wells or vessels through one or more temperature zones for chemical or biochemical reactions. It ensures that the same batch of the samples or reactants goes through a number of heat cycles in predetermined orders. Also, with the action of the flowing heat medium within the temperature zones, the temperature variation due to positional differences may be diminished. In this case, only a single optical or fluorescence detection device is required as different batches of samples arrive at different times for detection.

The thermal cycler device of the present invention is particularly suitable for slides or plates having arrays of reaction wells or reaction vessels, where the volume of sample solution is relatively small and the reaction vessels carrying the samples are distributed over the wide range of the slide or plate. As the slide plates moves through the temperature zones, together with the flowing heat medium, the reaction vessels or wells of the slide plates can be evenly heated or cooled. Instead of using complicated microfluidic design, the thermal cycler device of the present invention can provide various temperatures to different batches of samples independently.

The thermal cycler device of present invention may further include a circuit with programmable micro-processor(s) to control the temperature setting, conveyer advancing, and camera picturing, data logging, etc. The thermal cycler device of present invention may be further connected to an information collecting and data locking device (i.e. a computer) for the temperature setting, conveyer advancing, and camera picturing, data logging, data analysis, logical algorithm judgment, etc. The thermal cycler device of present invention may be connected to the computer to receive instructions and output data through wire or wireless connection.

The thermal cycler device of present invention may further include a bar code reader to read the label of the slides to be tested, and the computer may set the testing program according to the data of the read label, such as automatically setting the temperature profile of each temperature zone, conveyer moving speed, cycle numbers. The computer may analyze data and automatically generate a report according to the label setting format.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A thermal cycler device, comprising:

a conveyer, having a closed continuous loop conveying path;

a plurality of slide holders, disposed on the conveyer and separated with an equal distance and/or at an angle along the closed continuous loop conveying path of the conveyer for carrying a plurality of slide plates; and a plurality of temperature zones, arranged along the closed continuous loop conveying path and partially covering and accommodating the plurality of slide holders, wherein a temperature of at least one of the plurality of temperature zones is different from that of the other one of the plurality of temperature zones, the plurality of temperature zones exchanges heat with the plurality of slide plates at the same time, and wherein the plurality of slide holders carrying the plurality of slide plates moves together and passes through the plurality of temperature zones along the closed continuous loop conveying path and the plurality of slide plates passes through the plurality of temperature zones one by one.

2. The thermal cycler device as claimed in claim 1, wherein at least one of the plurality of temperature zones comprises at least one heat block located within the temperature zone and a heat medium filled within the temperature zone, and the at least one of the plurality of temperature zones exchanges heat with the plurality of slide plates through the heat medium.

3. The thermal cycler device as claimed in claim 1, wherein at least one of the plurality of temperature zones comprises at least one heat block located within the temperature zone and the at least one heat block directly contacts the plurality of slide plates to exchange heat with the plurality of slide plates.

4. The thermal cycler device as claimed in claim 1, further comprising a first temperature controller, connected to at least one of the plurality of temperature zones to control a temperature thereof to a predetermined fixed temperature.

5. The thermal cycler device as claimed in claim 4, further comprising a second temperature controller, connected to at least one of the plurality of temperature zones to control a temperature thereof to a predetermined temperature gradient.

6. The thermal cycler device as claimed in claim 1, further comprising an optical detection device arranged at a position of the closed continuous loop conveying path for detecting an optical signal from the plurality of slide plates.

7. The thermal cycler device as claimed in claim 1, further comprising an label detection device arranged at a position of the closed continuous loop conveying path, wherein each of the plurality of slide plates carries at least a sample containing a label and the label detection device detects the label of the sample.

8. A thermal cycler device, comprising:

a conveyer, having a closed continuous loop conveying path;

a plurality of slide holders, disposed on the conveyer and separated with an equal distance and/or at an angle along the closed continuous loop conveying path of the conveyer for carrying a plurality of slide plates; and a plurality of temperature zones, arranged along the closed continuous loop conveying path and partially covering and accommodating the plurality of slide holders, wherein a temperature and a length of at least one of the plurality of temperature zones are different from those of the other one of the plurality of temperature zones, the plurality of temperature zones exchanges heat with the plurality of slide plates at the same time, and wherein the plurality of slide holders carrying the plurality of slide plates moves together and passes through the plurality of temperature zones along the closed continuous loop conveying path and the plurality of slide plates passes through the plurality of temperature zones one by one.

9. The thermal cycler device as claimed in claim 8, wherein the temperature and of the at least one of the plurality of temperature zones is higher than that of the other one of the plurality of temperature zones, and the length of the at least one of the plurality of temperature zones is larger than that of the other one of the plurality of temperature zones.

10. The thermal cycler device as claimed in claim 9, wherein the at least one of the plurality of temperature zones comprises at least two heat blocks located respectively at an upper side and a lower side of the conveyer within the temperature zone and a heat medium filled within the temperature zone, and the at least one of the plurality of temperature zones exchanges heat with the plurality of slide plates through the heat medium.

11. The thermal cycler device as claimed in claim 9, wherein the at least one of the plurality of temperature zones comprises at least two heat blocks located respectively at an upper side and a lower side of the conveyer within the temperature zone and at least one of the at least two heat blocks directly contacts the plurality of slide plates to exchange heat with the plurality of slide plates.

12. The thermal cycler device as claimed in claim 9, wherein the other one of the plurality of temperature zones comprises at least one heat block located within the temperature zone and a heat medium filled within the temperature zone, and the other one of the plurality of temperature zones exchanges heat with the plurality of slide plates through the heat medium.

13. The thermal cycler device as claimed in claim 9, wherein the other one of the plurality of temperature zones comprises at least one heat block located within the temperature zone and the at least one heat block directly contacts the plurality of slide plates to exchange heat with the plurality of slide plates.

14. The thermal cycler device as claimed in claim 8, further comprising a first temperature controller, connected to at least one of the plurality of temperature zones to control a temperature thereof to a predetermined fixed temperature.

15. The thermal cycler device as claimed in claim 14, further comprising a second temperature controller, connected to at least one of the plurality of temperature zones to control a temperature thereof to a predetermined temperature gradient.

* * * * *